US010695815B2

(12) United States Patent
Saito et al.

(10) Patent No.: US 10,695,815 B2
(45) Date of Patent: Jun. 30, 2020

(54) PRESS-FORMED PRODUCT AND METHOD FOR DESIGNING THE SAME

(71) Applicant: NIPPON STEEL & SUMITOMO METAL CORPORATION, Tokyo (JP)

(72) Inventors: Masahiro Saito, Tokai (JP); Yoshiaki Nakazawa, Takarazuka (JP); Kenichiro Otsuka, Tokai (JP); Yasuhiro Ito, Kimitsu (JP); Masanori Yasuyama, Kimitsu (JP); Masatoshi Tokunaga, Kisarazu (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 15/575,824

(22) PCT Filed: May 10, 2016

(86) PCT No.: PCT/JP2016/063867

§ 371 (c)(1),
(2) Date: Nov. 21, 2017

(87) PCT Pub. No.: WO2016/190083

PCT Pub. Date: Dec. 1, 2016

(65) Prior Publication Data

US 2018/0126439 A1 May 10, 2018

(30) Foreign Application Priority Data

May 22, 2015 (JP) ..... 2015-104700

(51) Int. Cl.
*B21D 35/00* (2006.01)
*B21D 22/20* (2006.01)
(Continued)

(52) U.S. Cl.
CPC ..... *B21D 22/208* (2013.01); *B21D 22/022* (2013.01); *B21D 22/26* (2013.01); *B21D 35/006* (2013.01); *B21D 53/88* (2013.01)

(58) Field of Classification Search
CPC ..... B21D 22/208; B21D 22/26; B21D 22/20; B21D 22/022; Y10T 29/49671;
(Continued)

(56) References Cited

FOREIGN PATENT DOCUMENTS

| | | |
|---|---|---|
| CA | 2 836 080 | 11/2012 |
| CN | 102164692 | 8/2011 |

(Continued)

OTHER PUBLICATIONS

English Translation JP2006198672 (Year: 2006).*

*Primary Examiner* — Jason L Vaughan
*Assistant Examiner* — Amanda Kreiling
(74) *Attorney, Agent, or Firm* — Clark & Brody LP

(57) ABSTRACT

A press-formed product is shaped by press-working from a tailored blank made up of a plurality of metal sheets butt-welded together. The press-formed product includes a flange section, and an arc-shaped area which is an area of the flange section which is formed by stretch flange deformation, and in which an inner peripheral edge is open. A weld line of the tailored blank intersects with the inner peripheral edge and an outer peripheral edge of the arc-shaped area. An angle θ formed by the weld line and a maximum principal strain direction of the stretch flange deformation is 17 to 84°.

8 Claims, 13 Drawing Sheets

(51) Int. Cl.
*B21D 22/26* (2006.01)
*B21D 22/02* (2006.01)
*B21D 53/88* (2006.01)

(58) Field of Classification Search
CPC ..... Y10T 29/49673; Y10T 29/49826; Y10T 29/49616; Y10T 29/49622; Y10T 29/49629; Y10T 29/49941
See application file for complete search history.

(56) References Cited

FOREIGN PATENT DOCUMENTS

| | | | |
|---|---|---|---|
| JP | 2001-001062 | | 1/2001 |
| JP | 2002-020854 | | 1/2002 |
| JP | 2006-198672 | | 8/2006 |
| JP | 2006198672 A | * | 8/2006 |

* cited by examiner

PRESS-FORMED PRODUCT AND METHOD FOR DESIGNING THE SAME

TECHNICAL FIELD

The present invention relates to a press-formed product (hereinafter, also referred to simply as a "formed product") which is shaped from a starting material of metal sheet by press working. Particularly, the present invention relates to a press-formed product including a flange section which is formed by stretch flange deformation, and a method for designing the formed product.

BACKGROUND ART

For automobile skeleton components (hereafter, also referred to simply as "skeleton components") constituting a body of an automobile, efforts have been made to promote weight reduction and functional enhancement (for example, improvement of anti-collision performance). For that purpose, a tailored blank is used as the starting material for a skeleton component. The tailored blank is made up of a plurality of metal sheets integrated by being joined (for example, butt-welded) together, in which the plurality of metal sheets are different from each other in tensile strength, sheet thicknesses, and the like. Hereinafter, such a tailored blank is also referred to as a TWB. A press-formed product is obtained by press-working a TWB. A press-formed product is subjected, as needed, to trimming, restriking or the like, thereby being finished into a desired shape.

For example, a front pillar and a side sill are each a complex body of skeleton components. The front pillar is disposed on a fore side of a vehicle body, and extends vertically. The side sill is disposed in a lower portion of the vehicle body, and extends in a fore-to-aft direction. A lower end section of the front pillar and a fore end section of the side sill are coupled to each other. Here, some structures of the front pillar may adopt a structure which is divided into upper and lower sections. In this case, the upper section is called as a front pillar upper, and the lower section as a front pillar lower. A lower end section of the front pillar upper and an upper end section of the front pillar lower are coupled to each other.

The front pillar lower includes, as skeleton components, for example, a front pillar lower-outer (hereafter, also referred to simply as an "outer"), a front pillar lower-inner (hereafter, also referred to simply as an "inner"), and a front pillar lower-reinforcement (hereafter, also referred to simply as a "reinforcement"). The outer is disposed on the outer side in the vehicle width direction. The inner is disposed on the inner side in the vehicle width direction. The reinforcement is disposed between the outer and the inner. Among those, the outer is curved in an L-shape along the longitudinal direction, and has a hat-shaped cross section over the entire range in the longitudinal direction. Typically, the outer is a press-formed product.

FIGS. 1A and 1B are schematic diagrams to show an example of a front pillar lower-outer which is a press-formed product. Of these figures, FIG. 1A shows a plan view, and FIG. 1B shows an A-A cross sectional view of FIG. 1A. Note that, to help understanding of shape, the side to be coupled to the side sill is designated by a symbol "S", and the side to be coupled to the front pillar upper is designated by a symbol "U".

As shown in FIG. 1A, the front pillar lower-outer 10 includes a curved region (see an area surrounded by a two-dot chain line in FIG. 1A) 13 which is curved in an L-shape along the longitudinal direction, and a first region 11 and a second region 12, which are respectively connected to both ends of the curved region 13. The first region 11 extends in a straight fashion from the curved region 13 rearwardly in the travelling direction of an automobile to be coupled to the side sill. The second region 12 extends in a straight fashion upwardly from the curved region 13 to be coupled to the front pillar upper.

As shown in FIG. 1B, the cross sectional shape of the outer 10 is a hat shape over the entire range in the longitudinal direction from an end to be coupled to the front pillar upper to an end to be coupled to the side sill. Therefore, each of the curved region 13, the first region 11 and the second region 12, which constitute the outer 10, includes a top plate section 10*a*, a first vertical wall section 10*b*, a second vertical wall section 10*c*, a first flange section 10*d*, and a second flange section 10*e*. The first vertical wall section 10*b* is connected with the entire length of the side forming the inner side of curve of the both side sections of the top plate section 10*a*. The second vertical wall section 10*c* is connected with the entire length of the side forming the outer side of curve of the both side sections of the top plate section 10*a*. The first flange section 10*d* is connected with the first vertical wall section 10*b*. The second flange section 10*e* is connected with the second vertical wall section 10*c*.

It is possible to use a TWB for the production of such front pillar lower-outer 10. Regarding the method for shaping a press-formed product from the TWB, the following conventional techniques are available.

Japanese Patent Application Publication No. 2006-198672 (Patent Literature 1) discloses a technique to mitigate the load acting on the vicinity of a weld line of a TWB at the time of press working. In this technique, the TWB is provided with a cutout at a location slightly apart from the weld line. Patent Literature 1 describes that at the time of press working, strain which occurs in the vicinity of the weld line is dispersed by the cutout, thereby improving formability of the formed product.

Japanese Patent Application Publication No. 2001-1062 (Patent Literature 2) discloses a technique for applying press working on a TWB which is made up of two metal sheets each having a different tensile strength and a sheet thickness. In this technique, a weld line of the TWB is disposed on a portion where a gradient of strain would occur when a single metal sheet, which is not a TWB, is press worked. Then, a metal sheet having a higher strength is disposed on the side of larger strain, and a metal sheet having a lower strength is disposed on the side of smaller strain. As a result of this, strain will be reduced in press working such as deep drawing, bulging and the like. Patent Literature 2 describes that, as a result of that, cracking of the base metal which occurs in the metal sheet on the lower strength side is suppressed, thus improving the formability of formed product.

Japanese Patent Application Publication No. 2002-20854 (Patent Literature 3) discloses a technique to apply press working on a TWB which is made up of two metal sheets having similar levels of tensile strength and ductility. In this technique, a specific region in a formed product obtained by press working is subjected to a heat treatment such as nitriding, thereby strengthening the specific region. Patent Literature 3 describes that since deformation resistance of the metal sheet is uniform at the time of press working before the heat treatment, the formability of the formed product is improved.

CITATION LIST

Patent Literature

Patent Literature 1: Japanese Patent Application Publication No. 2006-198672

Patent Literature 2: Japanese Patent Application Publication No. 2001-1062

Patent Literature 3: Japanese Patent Application Publication No. 2002-20854

SUMMARY OF INVENTION

Technical Problem

When performing press-working, a portion of the blank (metal sheet) may undergo stretch flange deformation depending on the shape of the press-formed product. The stretch flange deformation refers to a deformation form in which as a working tool (press tooling) intrudes and moves into a blank, the blank stretches in a direction along the moving direction of the working tool as the working tool (press tooling) moves into the blank, and at the same time it stretches in a circumferential direction perpendicular to the moving direction.

For example, as shown in FIGS. 1A and 1B, a press-formed product (front pillar lower-outer 10), which is curved in an L-shape along the longitudinal direction, and has a hat-shaped cross section, is produced by using a die and a punch as the working tool. In the production of a press-formed product, a blank holder is used as needed. The blank holder is disposed adjacent to a punch. When performing press-working, an edge section of the blank is held between the blank holder and the die so that irregular deformation of the blank is suppressed. Moreover, in the production of a press-formed product, a pad may be used. The pad is disposed in opposition to a punch within a die. When performing press-working, the blank is held between the pad and the punch, thereby suppressing irregular deformation of the blank.

When shaping a press-formed product shown in FIGS. 1A and 1B described above, an arc-shaped area 14 on the inner side of curve of the curved region 13 in the area of the first flange section 10*d* stretches in a radial direction of an arc (a width direction of the curved region) and, at the same time, stretches in the circumferential direction of the arc (a longitudinal direction of the curved region). That is, the arc-shaped area 14 is formed by stretch flange deformation.

Conventionally, when producing a press-formed product by using a TWB, a weld line of the TWB has been disposed so as to avoid an area which undergoes stretch flange deformation (hereinafter, also referred to as a "stretch flange deformation field"). This is because if the weld line is disposed in a stretch flange deformation field, cracking occurs between the weld line and the base metal sheet due to the fact that deformation resistance is different between the welded metal and the base metal sheet.

Therefore, conventionally, the position to depose the weld line in the press-formed product shown in FIGS. 1A and 1B described above has been limited to an area of the first region 11 on the side of the side sill S, or an area of the second region 12 of the side of the front pillar upper U. This is because the area of the curved region 13 includes the arc-shaped area 14 which becomes a stretch flange deformation field. Therefore, the degree of freedom for designing a press-formed product using a TWB is limited.

Regarding such problems, in the technique of Patent Literature 1, a cutout provided in the TWB remains in the formed product after press-working. For that reason, it is inevitable to remove the cutout by trimming. In that case, it is difficult to reduce the production steps.

In the technique of Patent Literature 2, it is necessary to dispose a metal sheet having a higher strength on the side of larger strain, and a metal sheet having a lower strength on the side of smaller strain. Therefore, there is a risk that weight reduction and functional enhancement are hindered. Moreover, regarding the position to dispose the weld line of TWB, Patent Literature 2 only provides the following description. The weld line of TWB is disposed in a portion, 5 to 10 mm or more away, and within 200 mm or less, from a location where cracking occurs when press-working a single blank.

In the technique of Patent Literature 3, it is necessary to apply heat treatment such as nitriding to a formed product after press-working. Therefore, not only an excess amount of heat treatment cost is imposed, but also the number of the production steps will increase.

In short, any of the techniques of Patent Literatures 1 to 3 cannot readily realize improvement of the degree of freedom for designing a press-formed product.

The present invention has been made in view of the above described situations. It is an object of the present invention to provide a press-formed product having the following feature and a method for designing the same:

To improve the degree of freedom for designing a press-formed product which is shaped from a TWB.

Solution to Problem

A press-formed product according to one embodiment of the present invention comprises a tailored blank made up of a plurality of metal sheets butt-welded together. The press-formed product includes a flange section, and an arc-shaped area in which an inner peripheral edge is open in the area of the flange section. A weld line of the tailored blank intersects with the inner peripheral edge of the arc-shaped area, and an outer peripheral edge of the arc-shaped area. An angle formed by the weld line and a maximum principal strain direction is 17 to 84°.

The design method according to one embodiment of the present invention is a method for designing the above described press-formed product. In designing the press-formed product, the weld line is disposed such that during press-working, a relative difference between strain $d\varepsilon_{WL}y'$ in the direction along the weld line at the center in the width direction of the weld line, and strain $d\varepsilon_{BM}y'$ in the direction along the weld line in the vicinity of the weld line of the metal sheet is not more than 0.030.

Advantageous Effects of Invention

A press-formed product of the present invention and a method for designing the same have the following prominent effect:

Effect of enabling to improve the degree of freedom for designing a press-formed product which is shaped from a TWB.

DESCRIPTION OF EMBODIMENTS

Figure 1A:
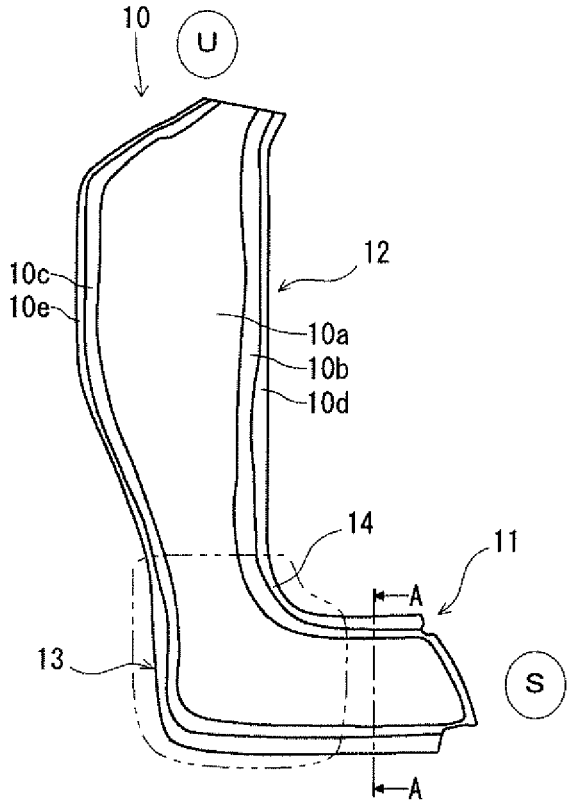
FIG. 1A is a plan view to schematically show an example of a front pillar lower-outer which is a press-formed product.

In order to achieve the above described objects, the present inventors have performed various tests, thereby conducting diligent investigation. As a result of that, they have obtained the following findings. When a press-formed product is produced from a TWB by press-working, if the weld line is simply disposed in a stretch flange deformation field, cracking occurs in the vicinity of the weld line, thereby deteriorating formability of the formed product. However, even when the weld line is disposed in the stretch flange deformation field, properly setting the position of the weld line makes it possible to suppress the occurrence of cracking, thus ensuring the formability of the formed product. As a result of that, it is possible to improve the degree of freedom for designing a press-formed product using a TWB.

The press-formed product of the present invention and the method for designing the same are completed based on the above described findings.

The press-formed product according to one embodiment of the present invention comprises a tailored blank made up of a plurality of metal sheets butt-welded together. The press-formed product includes a flange section, and an arc-shaped area in which an inner peripheral edge is open in the area of the flange section. The weld line of the tailored blank intersects with the inner peripheral edge of the arc-shaped area and an outer peripheral edge of the arc-shaped area. An angle formed by the weld line and a maximum principal strain direction is 17 to 84°. In a typical example, the press-formed product is shaped by press-working. At that moment, the arc-shaped area is formed by stretch flange deformation. The maximum principal strain direction is a maximum principal strain direction of the stretch flange deformation.

In the above described press-formed product, the angle formed by the weld line and a tangential line of the inner peripheral edge at an intersection point between the weld line and the inner peripheral edge is preferably 40 to 75°.

In the above described press-formed product, it is preferable that the number of the metal sheets for making up the tailored blank is two, and the two metal sheets are different from each other in at least one of tensile strength and sheet thickness.

In the case of this press-formed product, the following configuration may be adopted. The press-formed product is an automobile skeleton component which is curved in an L-shape along the longitudinal direction. The skeleton component has a hat-shaped cross-section over the entire range in the longitudinal direction. The skeleton component includes a curved region curved along its longitudinal direction, and a first region and a second region, respectively extending from both ends of the curved region. The skeleton component is a component which is supposed to be subjected to a collision load along an extended direction of the first region. The arc-shaped area is a flange section on the inner side of curve of the curved region. The sheet thickness of the metal sheet disposed on the side of the first region is larger than the sheet thickness of the metal sheet disposed on the side of the second region.

In the case of a press-formed product which has adopted such configurations, the following configuration can be adopted. The skeleton component is a front pillar lower-outer. The first region is coupled to a side sill, and the second region is coupled to a front pillar upper.

In a press-formed product which has adopted such a configuration, a multiplication value of a tensile strength and a sheet thickness of the metal sheet disposed on the side of the first region is substantially equal to a multiplication value of a tensile strength and a sheet thickness of the metal sheet disposed on the side of the second region. In a typical example, a difference between those multiplication values is not more than 600 mm·MPa.

The design method according to one embodiment of the present invention disposes the weld line so as to be in the following state, when designing the above described press-formed product. During press-working, a relative difference between a strain $d\varepsilon_{WL}y'$ in the direction along the weld line at the center in the width direction of the weld line, and strain $d\varepsilon_{BM}y'$ in the direction along the weld line in the vicinity of the weld line of the metal sheet is not more than 0.030. More preferably, the relative difference between strain $d\varepsilon_{WL}y'$ and strain $d\varepsilon_{BM}y'$ is 0 (zero).

Hereinafter, embodiments of the present invention will be described in detail with reference to the drawings. Here, as the press-formed product, a front pillar lower-outer among automobile skeleton components will be taken as an example.

[Press-Formed Product]

Figure 1B:
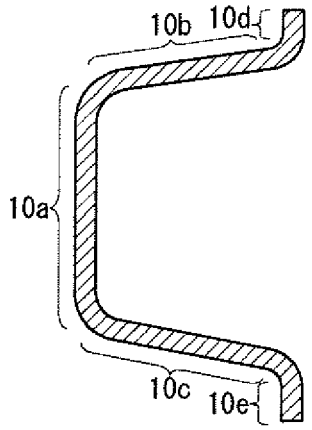
FIG. 1B is an A-A cross sectional view of FIG. 1A.
Figure 2:
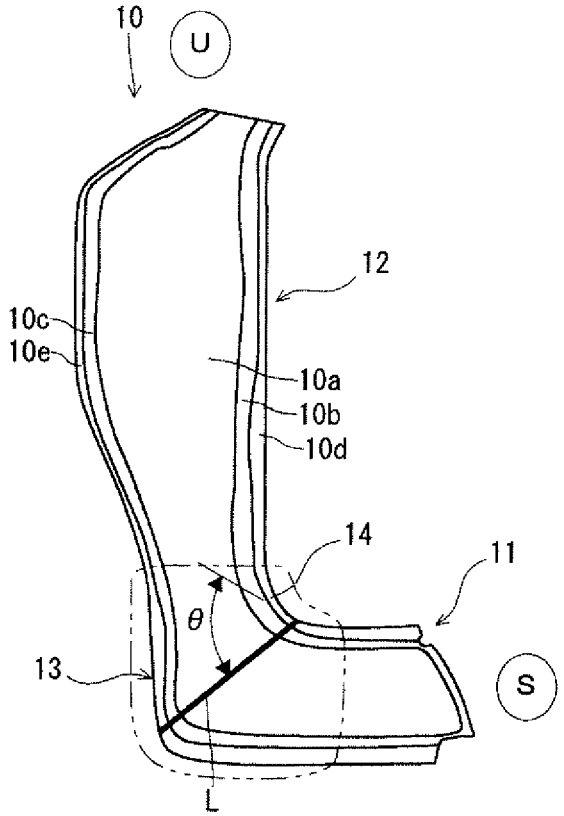
FIG. 2 is a plan view to schematically show an example of a front pillar lower-outer as a press-formed product of the present embodiment.
Figure 3:
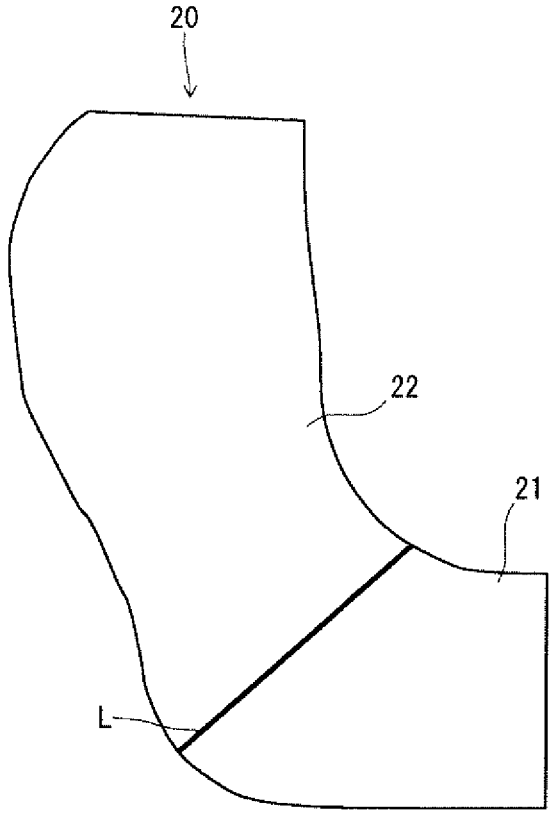
FIG. 3 is a plan view to schematically show a TWB which is used when the front pillar lower-outer shown in FIG. 2 is produced.
Figure 4:
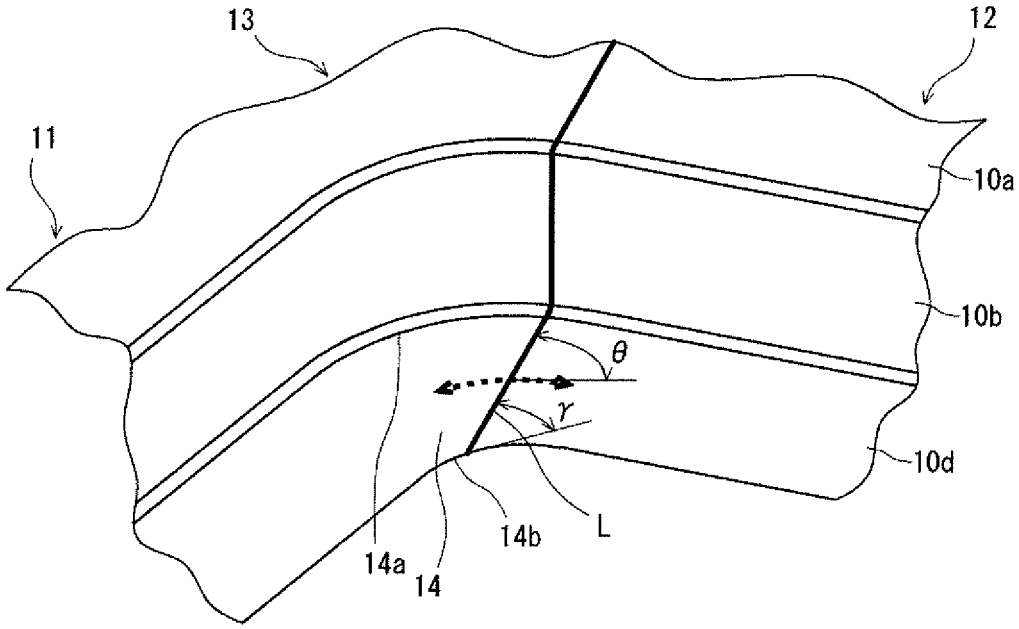
FIG. 4 is an enlarged perspective view to show an area on the inner side of curve of a curved region in the front pillar lower-outer shown in FIG. 2.

FIG. 2 is a plan view to schematically show one example of a front pillar lower-outer as a press-formed product of the present embodiment. FIG. 3 is a plan view to schematically show a TWB which is used when the front pillar lower-outer 10 shown in FIG. 2 is produced. FIG. 4 is an enlarged perspective view to show an area on the inner side of curve of the curved region in the front pillar lower-outer shown in FIG. 2. The outer 10 of the present embodiment shown in FIG. 2 is, as with the outer shown in FIG. 1A described above, curved in an L-shape along the longitudinal direction, and has a cross section of a hat-shape over the entire range in the longitudinal direction (see FIG. 1B).

As shown in FIG. 2, the outer 10 includes a curved region 13 which is curved in an L-shape along the longitudinal direction, and a first region 11 and a second region 12, which are respectively connected to both ends of the curved region 13. The first region 11 extends from the curved region 13 in a straight fashion rearwardly in the traveling direction of an automobile to be coupled to a side sill. The second region 12 extends from the curved region 13 in a straight manner upward to be coupled to a front pillar upper. The outer 10 is a skeleton component which constitutes the front pillar lower, and is supposed to be subjected to a collision load along an extended direction of the first region 11 to be coupled to the side sill.

The outer 10 of the present embodiment is shaped by press-working from a TWB 20 shown in FIG. 3. The weld line L of the TWB 20 is disposed so as to correspond to an area of the curved region 13 of the outer 10. In the outer 10, an arc-shaped area 14 on the inner side of curve of the curved region 13 in the area of the first flange section 10*d* becomes a stretch flange deformation field at the time of press-working. As shown in FIGS. 2 and 4, the outer peripheral edge 14*a* of the arc-shaped area 14 provides a ridgeline connecting to the first vertical wall section 10*b*. The inner peripheral edge 14*b* of the arc-shaped area 14 is open. The weld line L intersects with the inner peripheral edge 14*b* and the outer peripheral edge 14*a* of the arc-shaped area 14.

As shown in FIG. 3, the TWB 20, which is made up of two metal sheets joined by butt-welding, comprises a first metal sheet 21 and a second metal sheet 22. In the TWB 20, the first metal sheet 21 is disposed so as to be on the side of the first region 11 (on the side of the side sill) of the outer 10, and the second metal sheet 22 is disposed so as to be on the side of the second region 12 (on the side of the front pillar upper) of the outer 10. The first metal sheet 21 has a lower tensile strength than that of the second metal sheet 22. However, the first metal sheet 21 may have same tensile strength as that of the second metal sheet 22, or may have a higher tensile strength than that of the second metal sheet 22. Further, the first metal sheet 21 has a larger sheet thickness than that of the second metal sheet 22.

In the outer 10 of the present embodiment, the sheet thickness on the side of the side sill (on the side of the first region 11) corresponds to that of the first metal sheet 21, and the sheet thickness of the side of the front pillar upper (on the side of the second region 12) corresponds to that of the second metal sheet 22. That is, the sheet thickness on the side of the side sill is larger than that of the side of the front pillar upper. Since the sheet thickness on the side of the first region 11 to be coupled to the side sill is large, axial collapse performance of the first region 11 will be improved. Thereby, it is possible to improve the anti-collision performance of the outer 10. On the other hand, since the sheet thickness on the side of the second region 12, which is to be coupled with the front pillar upper, is small, it is possible to realize weight reduction of the outer 10. Since the sheet thickness on the side of the second region 12 has a lower contribution to the axial collapse performance of the first region 11, there will be no hindrance to the anti-collision performance.

[Disposition of Weld Line]

If the weld line L of the TWB 20 is simply disposed in the arc-shaped area 14 of the outer 10, cracking will occur in the vicinity of the weld line L. This is because the arc-shaped area 14 becomes a stretch flange deformation field at the time of press-working. In the present embodiment, in the arc-shaped area 14 of the outer 10, an angle θ (hereinafter, also referred to as a "welding-line first angle") formed by the weld line and a maximum principal strain direction of the stretch flange deformation is set to 17 to 84°. The maximum principal strain direction refers to a circumferential direction of a curved arc in a portion where a sheet-thickness reduction rate is maximum (hereinafter, also referred to as a "maximum sheet-thickness reduction section") of the arc-shaped area 14 where the sheet thickness is reduced due to stretch flange deformation at the time of press working (see a dotted line arrow in FIG. 4).

The maximum sheet-thickness reduction section appears in the vicinity of the weld line L on the side of the metal sheet which has a lower equivalent strength of the first and second metal sheets 21 and 22 joined to each other across the weld line L. The equivalent strength of the metal sheet refers to a multiplication value [mm·MPa] of tensile strength [MPa] and sheet thickness [mm] of the metal sheet. The vicinity of the weld line L means, for example, a range of 0.5 to 4 mm from a boundary between the weld line L and the metal sheet on the side of lower equivalent strength. When the sheet thickness of the metal sheet on the side of lower equivalent strength is t [mm], the vicinity of the weld line L may refer to a range of 0.5×t to 4×t [mm] from the boundary between the weld line L and the metal sheet on the side of lower equivalent strength. The maximum sheet-thickness reduction section refers to a region which exhibits a sheet thickness reduction up to a value of work hardening coefficient (n-value) of the metal sheet on the side of lower equivalent strength, or 0.8 times of the n-value.

The maximum principal strain direction can be easily recognized from the shape of the press-formed product (outer 10). Specifically, when concentric arcs centering on the arc center of the outer peripheral edge 14*a* of the arc-shaped area 14 is drawn, the direction along the tangential line to the arc in the maximum sheet-thickness reduction section becomes the maximum principal strain direction.

If the welding-line first angle θ is 17 to 84°, it is possible to reduce the sheet-thickness reduction rate in the maximum sheet-thickness reduction section, thereby allowing suppression of cracking. As a result of that, it is possible to ensure the formability of a formed product.

Moreover, if the weld line L of the TWB 20 is simply disposed on the arc-shaped area 14 of the outer 10, cracking is likely to occur in the vicinity of the intersection point between the weld line L and the inner peripheral edge 14*b* of the arc-shaped area 14. Such cracking occurs in the vicinity of the weld fine L on the side of the metal sheet having lower equivalent strength of the first and second metal sheets 21 and 22 joined to each other across the weld line L. Therefore, in the present embodiment, an angle γ (hereinafter, also referred to as a "welding-line second angle") formed by the weld line L and the tangential line of the inner peripheral edge 14*b* at the intersection point between the weld line L and the inner peripheral edge 14*b* is set to 40 to 75°.

If the welding-line second angle γ is 40 to 75°, it is possible to suppress occurrence of cracking at the inner peripheral edge of the arc-shaped area. As a result of that, it is possible to ensure the formability of the formed product.

The mode of the press-forming for producing the outer 10 of the present embodiment may be appropriately selected according to the shape of the formed product. For example, not only flange forming, but also bending, drawing, bulging, bole expanding, and the like can be combined. As a press tooling, a die paired with a punch is used. Further, a blank holder, a pad, and the like for holding the blank may be used.

Moreover, in the outer 10 of the present embodiment, the weld line L is disposed in the curved region 13. This makes it possible to improve material yield compared with a case in which the weld line is disposed in a straight-shaped portion of the first region 11 (on the side of the side sill) or the second region 12 (on the side of the front pillar upper). Therefore, it is possible to reduce production cost of the formed product.

Further, the outer 10 of the present embodiment absorbs higher energy upon collision, thus improving anti-collision performance compared with a case in which the weld line is disposed in a straight-shaped portion on the side of the first region 11 to be coupled to the side sill. Moreover, the outer 10 of the present embodiment absorbs higher energy in view of unit volume upon collision compared with a case in which the weld line is disposed in a straight-shaped portion on the side of the second region 12 to be coupled with the front pillar upper. Therefore, it is possible to combine weight reduction and functional enhancement in a good balance.

As described above, the outer 10 of the present embodiment is shaped from a TWB 20 which is made up of the first metal sheet 21 and the second metal sheet 22. In this case, it is preferable that an equivalent strength of the first metal sheet 21 disposed on the side of the first region 11 is substantially equal to an equivalent strength of the second metal sheet 22 disposed on the side of the second region 12. This is because the deformation resistances of the first and second metal sheets 21 and 22 become equal at the time of press working, thus improving the formability of formed product. The statement "equivalent strength is substantially equal" permits the difference in equivalent strength up to 600 mm·MPa. That is, the difference between the equivalent strength of the first metal sheet 21 and the equivalent strength of the second metal sheet 22 is preferably not more than 600 mm·MPa. Such difference in the equivalent strength is preferably not more than 400 mm·MPa, and more preferably not more than 350 mm·MPa.

When producing the outer 10 of the present embodiment, the width of the weld line L of the TWB 20 is preferably smaller. Because, in the present embodiment, focusing on the deformation in the weld line direction in an area including the weld line L and its vicinity, its deformation is investigated in line with actual situation. The deformation is based on the amount of strain in the weld line direction at the center in the width direction of the weld line L. As a welding method to form a narrow width weld line L, a laser welding may be adopted. Besides, a plasma welding may also be adopted.

[Design of Proper Disposition of Weld Line]

When the weld line of the TWB is disposed so as to intersect with the inner peripheral edge and the outer peripheral edge of the arc-shaped area, in the arc-shaped area which becomes a stretch flange deformation field of the press formed product, the deformation field (strain field) of an area including the weld line and its vicinity is strictly a deformation field of uniaxial tension, or a deformation field closer to plane strain. In particular, in the area other than the inner peripheral edge of the arc-shaped area, the deformation field becomes close to plane strain (hereinafter, also referred to as a "plane strain deformation field"). On the other hand, in the inner peripheral edge of the arc-shaped area, the deformation field becomes a uniaxial tensile deformation field. This is because the inner peripheral edge is open.

Figure 5:
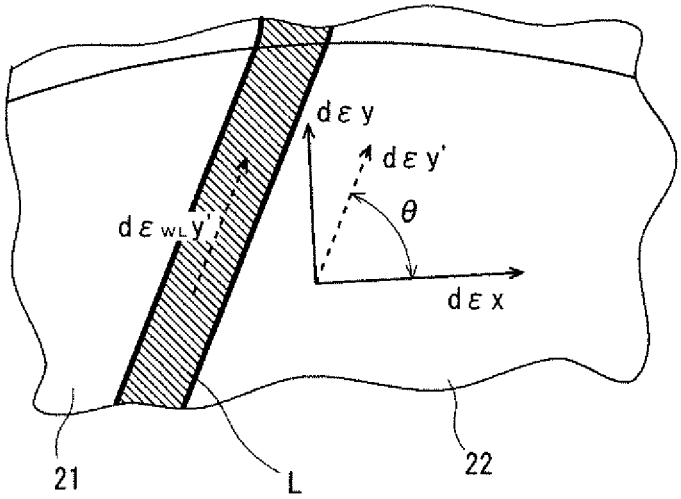
FIG. 5 is a schematic diagram to show an occurrence situation of strain in a stretch flange deformation field.

FIG. 5 is a schematic diagram to show the occurrence situation of strain in a stretch flange deformation field. In reality, the weld line L has a width (see a hatched part in FIG. 5). Here, consider a case in which the weld line L intersects with the circumferential direction (that is, the maximum principal strain direction of flange deformation) of the curved arc of the arc-shaped area at an angle θ (that is, the above described welding-line first angle). In the arc-shaped area which becomes the stretch flange deformation field, strain (Ex occurs in the circumferential direction of the curved arc in the base metal sheet 21, 22 in the vicinity of the weld line. Hereinafter, this strain dεx is also referred to as "circumferential strain". Further, strain dεy occurs in a direction perpendicular to the circumferential direction of the curved arc (that is, a radial direction of the curved arc). Hereinafter, this strain dεy is also referred to as radial strain. A ratio β (=dεy/dεx) of both the strains varies according to a Lankford value (hereinafter, also referred to as an "r-value") of the base metal sheet.

In this case, the radial strain dεy can be represented by the following Formula (1).

$$d\varepsilon y = d\varepsilon x \times (-r)/(1+r) \quad (1)$$

where, r represents an r-value.

Moreover, regarding strain components based on the circumferential strain dεx and the radial strain dεy which occur in the base metal sheets 21, 22 in the vicinity of the weld line, strain dεy' in a direction along the weld line L (hereinafter, also referred to as a "weld line direction") can be represented by the following Formula (2). Hereinafter, the strain dεy' is also referred to as BM welding-line direction strain dεy' (or "$d\varepsilon_{BM}y'$"). This Formula (2) is derived by coordinate transforming the circumferential strain dεx and the radial strain dεy by using the tensor coordinate transformation rule.

$$d\varepsilon y' = d\varepsilon x \times (\cos\theta)^2 + d\varepsilon y \times (\sin\theta)^2 \quad (2)$$

Substituting Formula (1) into Formula (2), the BM welding-line direction strain dεy' can also be represented by the following Formula (3).

$$d\varepsilon y' = d\varepsilon x \times (\cos\theta)^2 + d\varepsilon x \times (-r)/(1+r) \times (\sin\theta)^2 \quad (3)$$

Any of Formulas (1) to (3) is common to the uniaxial tensile deformation field and the plane strain deformation field. In such a stretch flange deformation field, the maximum sheet-thickness reduction section appears in the vicinity of the weld line on the side of the metal sheet having a lower equivalent strength of the two metal sheets 21 and 22 which are joined to each other across the weld line L. Here, regarding a portion of the weld line adjacent to the maximum sheet-thickness reduction section in the circumferential direction of the curved arc, let the strain in the weld line direction at the center in the width direction of the weld line be $d\varepsilon_{WL}y'$. Hereinafter, this strain $d\varepsilon_{WL}y'$ is also referred to as WL welding-line direction strain $d\varepsilon_{WL}y'$.

When the weld line L is disposed in the stretch flange deformation field, cracking that occurs in the vicinity of the weld line is caused by shear deformation which occurs between the weld line L and the base metal sheet (metal sheet 22 in FIG. 5) on the side of lower equivalent strength. Such shear deformation occurs due to the fact that there is difference in material characteristics between the welded metal and base metal sheet. Thus, it can be said that decreasing shear deformation can suppress the occurrence of cracking.

Then, in the present embodiment, when designing a press-formed product, the weld line is disposed such that relative difference between the WL welding line direction strain $d\varepsilon_{WL}y'$ and the BM welding-line direction strain dεy' becomes small during press working. Specifically, according to actual situation, the weld line may be disposed such that relative difference between the WL welding-line direction strain $d\varepsilon_{WL}y'$ and the BM welding-line direction strain dεy' becomes not more than 0.030. As relative difference between the WL welding-line direction strain $d\varepsilon_{WL}y'$ and the BM welding-line direction strain dεy' decreases, the shear deformation which occurs between the weld line and the base metal sheet on the side of lower equivalent strength decreases. This will make it possible to suppress the occurrence of cracking, thus ensuring formability of the formed product. As a result, it is possible to improve the degree of freedom for designing a press-formed product using a TWB. In particular, disposing the weld line such that relative difference between the WL welding-line direction strain $d\varepsilon_{WL}y'$ and the BM welding-line direction strain dεy' becomes 0, will make it possible to most effectively suppress the occurrence of cracking.

[Disposition of Weld Line in Plane Strain Deformation Field: Welding-Line First Angle θ]

Figure 6A:
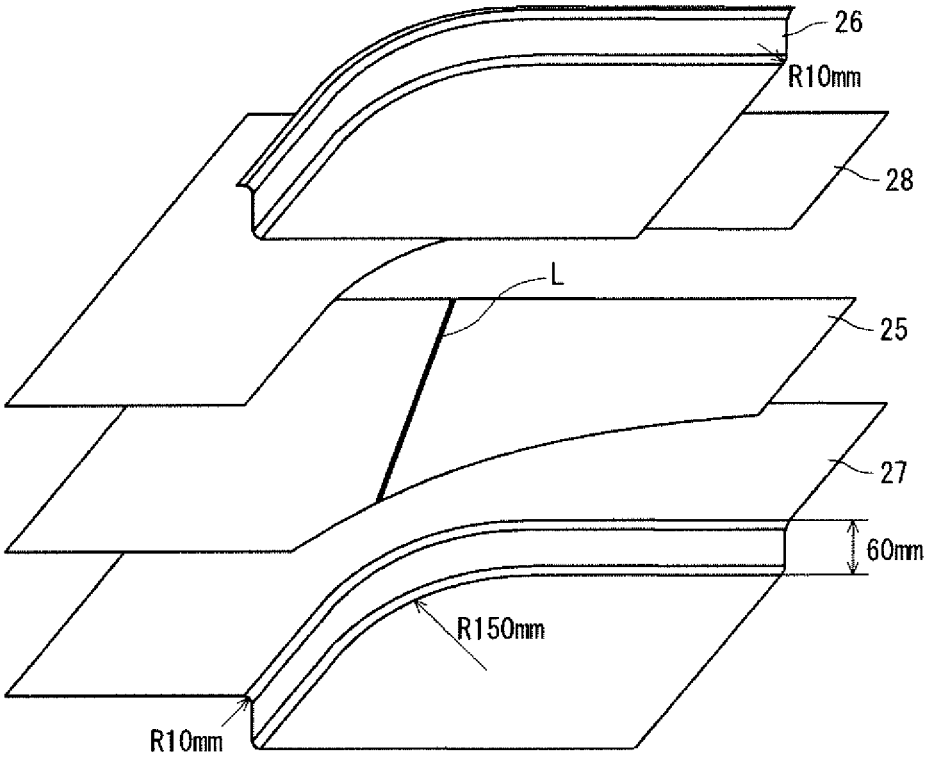
FIG. 6A is a perspective view to show an analysis model including a press tooling, in which an outline of an FEM analysis performed to investigate the disposition of a weld line in a plane strain deformation field (stretch flange deformation field) is schematically shown.
Figure 6B:
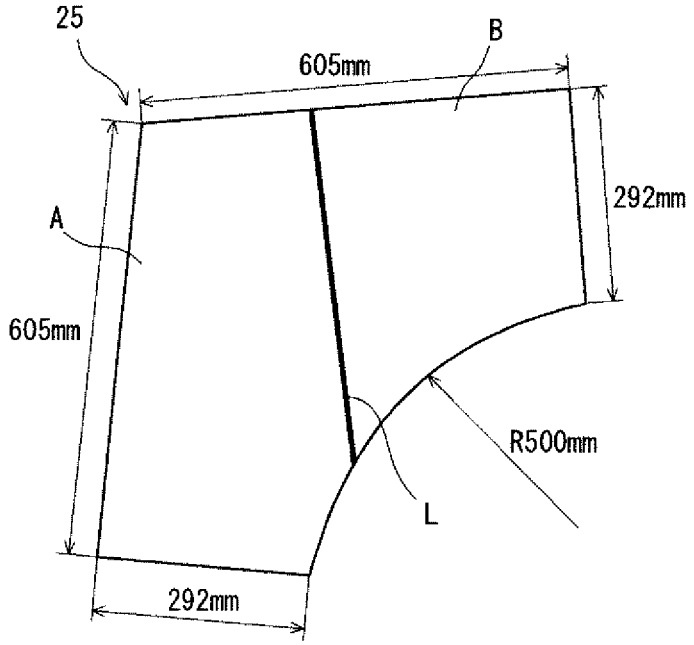
FIG. 6B is a plan view to show the shape of the blank in the analysis model of FIG. 6A.
Figure 6C:
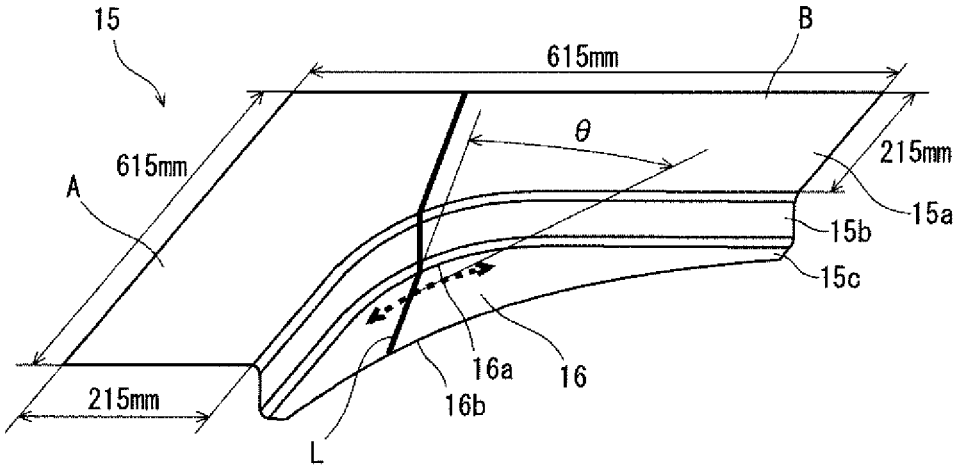
FIG. 6C is a perspective view to show the shape of a formed product which is shaped by using the analysis model of FIG. 6A.

FIGS. 6A to 6C are diagrams to schematically show an outline of an FEM analysis performed to investigate the disposition of the weld line in a plane strain deformation field (stretch flange deformation field). Among these figures, FIG. 6A is a perspective view to show an analysis model including a press tooling. FIG. 6B is a plan view to show the shape of a blank. FIG. 6C is a perspective view to show a shape of a formed product.

As shown in FIG. 6C, as a formed product including a plane strain deformation field of stretch flange deformation, a press-formed product 15 which is curved in an L-shape along the longitudinal direction was adopted. This press-formed product 15 includes a top plate section 15*a* which is curved in an L-shape, a vertical wall section 15*b* connected to the side section of the inner side of curve of this top plate section 15*a*, and a flange section 15*c* connected to the vertical wall section 15*b*. The flange section 15*c* includes an arc-shaped area 16 formed by stretch flange deformation. This formed product 15 includes the weld line L such that it intersects with the inner peripheral edge 16*b* and the outer peripheral edge 16*a* of the arc-shaped area 16.

As a blank for shaping the press-formed product 15, a TWB 25 made up of two metal sheets A and B was adopted as shown in FIG. 6B. In this TWB 25, the weld line L was disposed at a position corresponding to the arc-shaped area 16 of the press formed product 15. The metal sheet A was a high tensile strength steel sheet corresponding to JAC980Y of Japan Iron and Steel League Standards (hereinafter, also referred to as "980 MPa class High Tensile Strength Steel"), and the metal sheet B was a high tensile strength steel sheet corresponding to JAC780Y of the same standards (hereinafter, also referred to as "780 MPa class High Tensile Strength Steel"). The sheet thickness of any of those was 1.6 mm. That is, the equivalent strength of the metal sheet A was higher than that of the metal sheet B.

Press working was performed by using a die 26, a punch 27 and a pad 28 as shown in FIG. 6A. At that time, in the formed product 15, the disposition of the weld line L of the TWB 25 was changed such that the angle θ (welding-line first angle) formed by the weld line L and the maximum principal strain direction of stretch flange deformation had four levels: 23°, 40°, 72°, and 86°. At any of the levels, the maximum sheet-thickness reduction section appeared not in the vicinity of the inner peripheral edge 16*b* of the arc-shaped area 16, but in the vicinity of the outer peripheral edge 16*a* connected to the vertical wall section 15*b*. Furthermore, the location where the maximum sheet-thickness reduction section occurred was at the metal sheet (metal sheet B) on the side of lower equivalent strength in the vicinity of the weld line L. The results are shown in Table 1 below.

TABLE 1

| Welding-line First Angle θ [°] | BM Welding-line Direction Strain dεy' | WL Welding-line Direction Strain dεWLy' | Strain Relative Difference \|dεy' − dεWLy'\| | Sheet-thickness Reduction Rate [%] |
|---|---|---|---|---|
| 23 | 0.151 | 0.129 | 0.022 | 16 |
| 40 | 0.144 | 0.150 | 0.006 | 15 |
| 72 | −0.010 | 0.019 | 0.029 | 25 |
| 86 | −0.019 | 0.015 | 0.034 | 34 |

As shown in Table 1, the sheet-thickness reduction rate was lowest when the welding-line first angle θ was 40°. Therefore, in the present embodiment, based on conditions actually used in press working, the welding-line first angle θ is preferably 17 to 84°. This is because the sheet-thickness reduction rate can be kept low, and thus the occurrence of cracking in the vicinity of the weld line can be suppressed. The welding-line first angle θ is preferably 17 to 71°, more preferably 19 to 71°, and further preferably 25 to 71°.

The relative difference ($|d\varepsilon y' - d\varepsilon_{WL}y'|$) between the WL welding-line direction strain $d\varepsilon_{WL}y'$ and the BM welding-line direction strain dεy' is preferably as small as possible. Therefore, the relative difference is preferably not more than 0.030, more preferably not more than 0.025, and further preferably 0.

[Disposition of Weld Line in Uniaxial Tensile Deformation Field: Welding-Line Second Angle γ]

Figure 7:
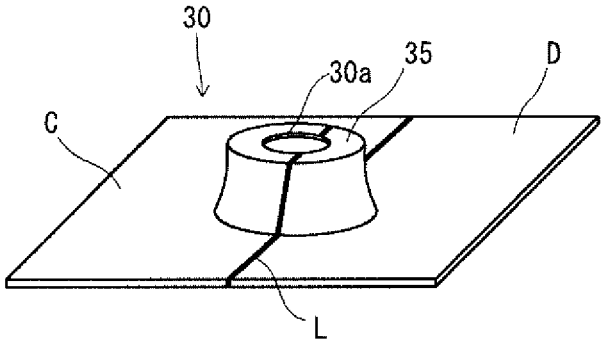
FIG. 7 is a perspective view to show a press-formed product by a hole expansion test, which is performed to investigate the disposition of the weld line in a uniaxial tensile deformation field (stretch flange deformation field).
Figure 8:
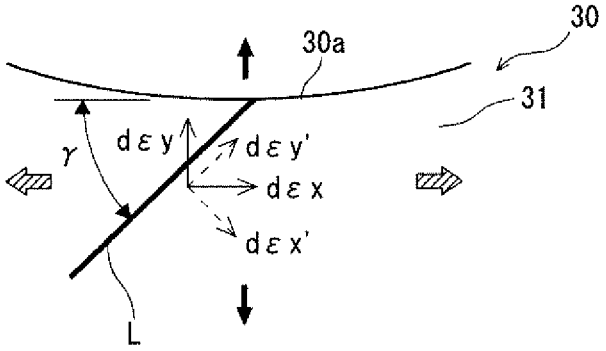
FIG. 8 is a schematic diagram to show an occurrence situation of strain in the stretch flange deformation of the press-formed product shown in FIG. 7.

FIG. 7 is a perspective view to show a press-formed product by a hole expansion test performed to investigate the disposition of the weld line in a uniaxial tensile deformation field (stretch flange deformation field). FIG. 8 is a schematic diagram to show the occurrence situation of strain in the stretch flange deformation of the press-formed product shown in FIG. 7. Note that details of the hole expansion test will be described in the following examples.

The hole expansion test is a test to thrust a punch into a blank formed with a circular hole, thereby expanding the hole in a concentric manner. As shown in FIG. 7, a press-formed product 30 shaped by the hole expansion test has a hole 30*a*. A circular area 31 surrounding the hole 30*a* becomes a stretch flange deformation field. For that reason, the circular area 31 corresponds to the above described arc-shaped area 14, and the hole 30*a* corresponds to the inner peripheral edge 14*b* of the above described arc-shaped area 14. Here, consider a case in which the weld line L intersects with the circumferential direction of the hole 30*a* (that is, a tangential direction of the hole 30*a* at the intersection point between the weld line L and the hole 30*a*) at an angle γ (that is, the above described welding-line second angle).

In the stretch flange deformation field in the hole expansion test, as the working tool (punch) enters and advances, the blank stretches in a direction along the moving direction of the working tool. This direction is a radial direction of the hole 30*a* as shown by a solid-line arrow in FIG. 8. Moreover, as the hole 30*a* expands, the blank stretches in a direction perpendicular to the direction along the moving direction of the working tool. This direction is the circumferential direction of the hole 30*a* (tangential direction of the hole 30*a*) as shown by hatched arrows in FIG. 8. Here, the deformation of the blank in the radial direction of the hole 30*a* is determined by a strain ratio β of uniaxial tension. That is, supposing the strain in the circumferential direction of the hole 30*a* to be dεx, the strain dεy in the radial direction is determined by Formula (1) described above. Such stretch flange deformation field is regarded as a uniaxial tensile deformation field.

Since the hole 30*a* and the outer peripheral edge of the circular area 31 are concentric circles in the press-formed product 30 by the hole expansion test, θ can be replaced by γ in Formula (3) described above. In this case, supposing dεx to be 1, the following Formula (4) will be derived. As shown in Formula (4), BM welding-line direction strain dεy' varies depending on the angle γ of the weld line (that is, the welding-line second angle), and the r-value of the base metal sheet.

$$d\varepsilon y' = (\cos\gamma)^2(-r)/(1+r)\times(\sin\gamma)^2 \quad (4)$$

Figure 9:
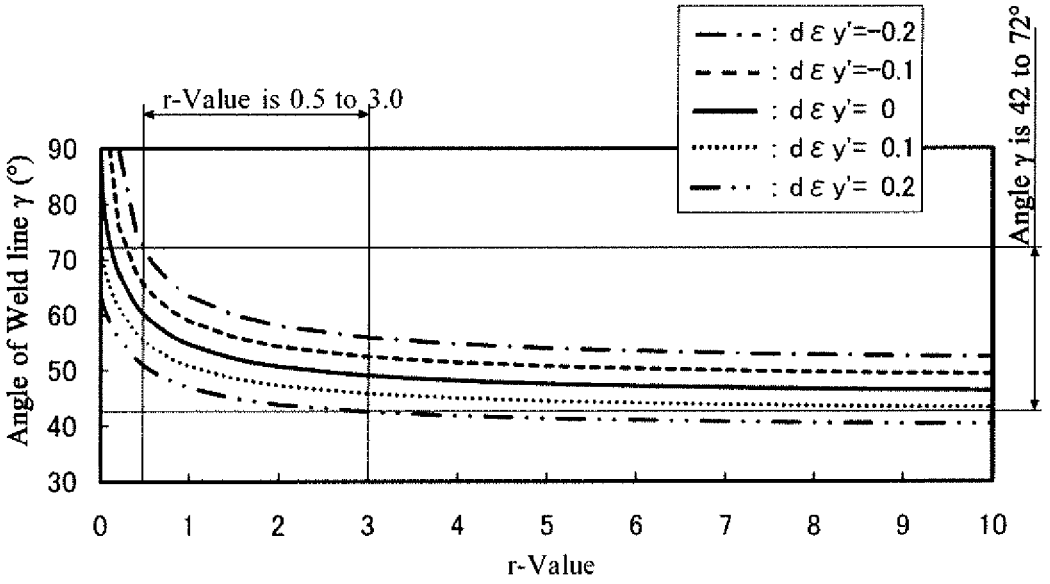
FIG. 9 is a diagram to show a correlation between an angle γ of the weld line and an r-value of the base metal sheet.

FIG. 9 is a diagram to show correlation between the angle γ of the weld line and the r-value of the base metal sheet. FIG. 9 respectively shows situations of cases in which the BM welding-line direction strain dεy' is −0.2, −0.1, 0, 0.1, and 0.2.

To suppress the occurrence of cracking in the vicinity of the intersection point between the hole of the formed product by the hole expansion test (that is, the inner peripheral edge of the arc-shaped area of the press-formed product) and the weld line, it is necessary to arrange that the BM welding-line direction strain dεy' is −0.2 to 0.2. Here, a common metal sheet (examples: hot-rolled steel sheet, cold-rolled steel sheet, plated steel sheet, Al alloy sheet, and Ti alloy sheet) has an r-value of 0.5 to 3.0. The r-value is that of the base metal sheet on the side of lower equivalent strength in which cracking is more likely to occur. From what has been described so far, the welding-line second angle γ is preferably 42 to 72°.

In the present embodiment, the welding-line second angle γ may be defined to be 40 to 75°, slightly wider than 42 to 72°. This is because, considering the amount of deformation of an area which softens due to welding heat in the vicinity of weld line, a slight extension of the angle γ can be permitted.

The BM welding-line direction strain dεy' is preferably as small as possible. Therefore, the BM welding-line direction strain dεy' is preferably −0.1 to 0.1, more preferably −0.025 to 0.025, and further preferably 0. Accordingly, from FIG. 9, the welding-line second angle γ is preferably 45 to 66°, more preferably 47 to 62°, and further preferably 48 to 60°.

When shaping an outer as a press-formed product of the present embodiment, steel sheet having a tensile strength of not lower than 440 MPa, Al alloy sheet, and Ti alloy sheet, are used as a metal sheet. The r-values of these metal sheets are 0.5 to 3.0. Therefore, in this case, the welding-line second angle γ is preferably 45 to 72°.

Besides, the present invention will not be limited to the above described embodiments, and can be subjected to various modifications within a scope not departing from the spirit of the present invention. For example, the press-formed product will not be particularly limited as long as it includes a flange section formed by stretch flange deformation. Moreover, an automobile skeleton component as a press-formed product will not be limited to a front pillar lower-outer as long as it is a component which is curved in an L-shape along the longitudinal direction, and is supposed to be subjected to a collision load along an extended direction of the first region, and may be a rear side outer, etc.

Moreover, the TWB will not be particularly limited, as long as it is made up of a plurality of metal sheets butt-welded together. For example, when the TWB is made up of two metal sheets, it is only necessary that the metal sheets are different from each other in at least one of tensile strength and sheet thickness. The TWB may be made up of three or more metal sheets.

EXAMPLES

[Hole Expansion Test]

A hole expansion test was conducted by using a TWB to investigate the relationship between the welding-line second angle γ and the formability.

Figure 10:
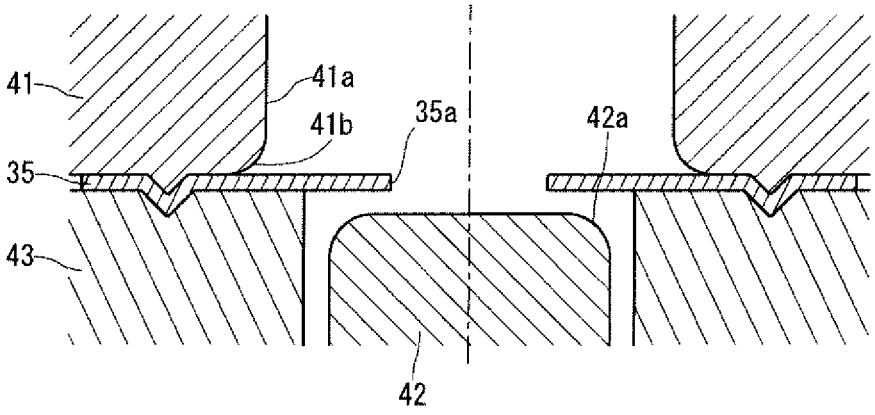
FIG. 10 is a cross sectional view to schematically show an outline of a hole expansion test.
Figure 11:
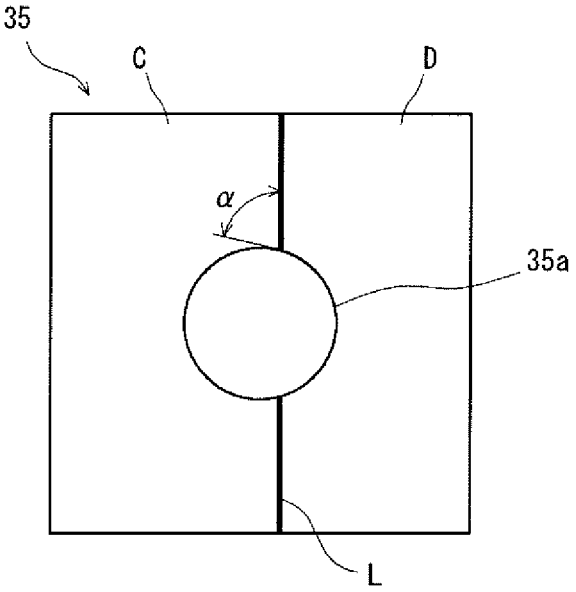
FIG. 11 is a plan view to show a TWB used in the hole expansion test.

FIG. 10 is a cross sectional view to schematically show an outline of a hole expansion test. FIG. 11 is a plan view to show a TWB used in the hole expansion test. As shown in FIG. 10, in the hole expansion test, a die 41 was used as an upper die, and an aperture 41*a* having a diameter of 54 mm was provided at the center of the die 41. A round chamfered section 41*b* having a radius of 5 mm was provided on a peripheral edge at an entrance of an aperture 41*a*. On the other hand, as a lower die, a column-shaped punch 42 was disposed on a central axis of the aperture 41*a* of the die 41. The diameter of the punch 42 was 50 mm, and a round chamfering radius of a shoulder section 42*a* of the punch 42 was 5 mm. Press forming (hole expanding) was performed by thrusting the punch 42 into a blank 35. Such thrusting was ended at a time point when cracking occurred at the hole 35*a* of the blank 35. When press-forming, the peripheral edge section of the blank 35 was held by the die 41 and the blank holder 43.

As shown in FIG. 11, a TWB 35 made up of two metal sheets C and D butt-welded together was used as the blank. The TWB 35 had a square shape, each side of which had a length of 100 mm. A hole 35*a* having a diameter of 30 mm was provided at the center of the TWB 35. In the TWB 35 before shaping, an angle α (hereinafter, also referred to as a "weld line angle before shaping") formed by the weld line L and a tangential line of the hole 35*a* at an intersection point between the weld line L and the hole 35*a* was varied into 7 levels of 45°, 60°, 75°, 90°, 105°, 120°, and 135°. Five pieces of TWBs were prepared for each of the 7 levels, and the hole expansion test was conducted for all the TWBs. The welding of metal sheets C and D was conducted by laser welding.

The metal sheet C was made of 980 MPa class High Tensile Strength Steel, and its sheet thickness was 1.6 mm. The metal sheet D was made of 780 MPa class High Tensile Strength Steel, and its sheet thickness was 1.4 mm. That is, the equivalent strength of the metal sheet C was higher than that of the metal sheet D.

On the metal sheet D on the side of lower equivalent strength, an average r-value (average plastic strain ratio) at an additional strain amount of 10% was calculated in conformity with JIS Z 2254 (1996), and found to be 0.712. When the r-value was 0.712, supposing the angle γ be 57.2°, the BM welding-line direction strain dεy' in Formula (4) described above will become 0 (zero).

As shown in FIG. 7 described above, a diameter d2 (mm) of an expanded hole 30*a* in each formed product 30 after press forming (hole expanding) was measured. From a diameter d1 (mm) of the hole 35*a* before shaping and the diameter d2 (mm) of the hole 30*a* after shaping, a hole expansion rate λ was calculated by the following Formula (5). Further, in each formed product 30 after shaping, an angle formed by the weld line L and a tangential line of the hole 30*a* at an intersection point between the weld line L and the hole 30*a*, that is, a weld line second angle γ was measured.

$$\lambda=(d2-d1)/d1\times100 \quad (5)$$

Figure 12A:
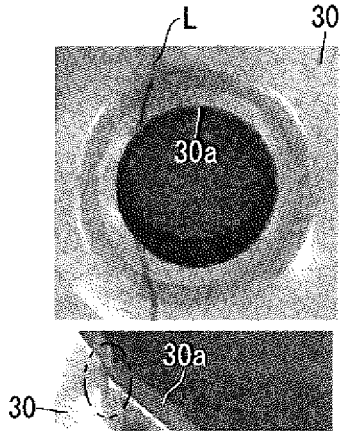
FIG. 12A is a photograph to show an appearance of a representative press-formed product by a hole expansion test, showing a case in which a welding-line second angle γ is about 43°.
Figure 12B:
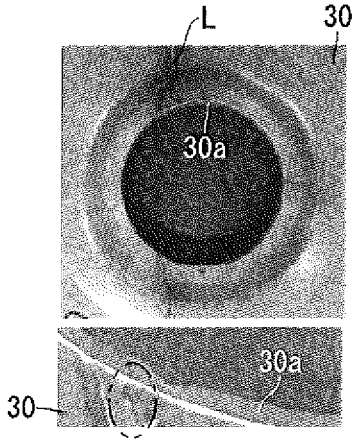
FIG. 12B is a photograph to show an appearance of a representative press-formed product by a hole expansion test, showing a case in which the welding-line second angle γ is about 58°.
Figure 12C:
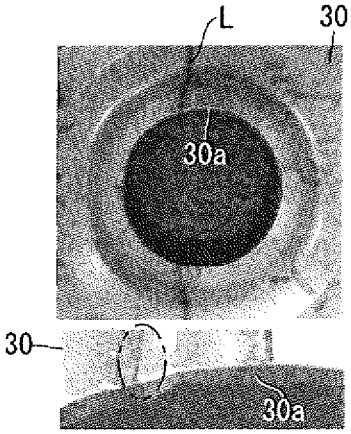
FIG. 12C is a photograph to show an appearance of a representative press-formed product by a hole expansion test, showing a case in which the welding-line second angle γ is about 68°.
Figure 12D:
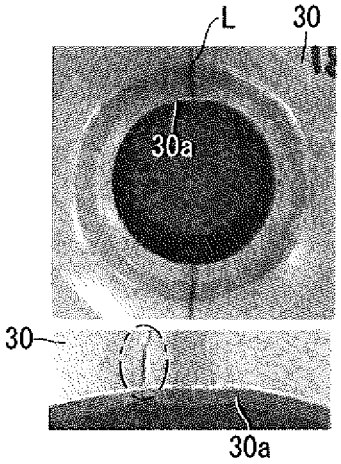
FIG. 12D is a photograph to show an appearance of a representative press-formed product by a hole expansion test, showing a case in which the welding-line second angle γ is about 90°.

FIGS. 12A to 12D are each a photograph to show an appearance of a representative press-formed product by a hole expansion test. Among these figures, FIG. 12A shows a case in which a welding-line second angle γ is about 43° (the weld line angle before shaping is 45°). FIG. 12B shows a case in which the welding-line second angle γ is about 58° (the weld line angle before shaping is 60°). FIG. 12C shows a case in which the welding-line second angle γ is about 68° (the weld line angle before shaping is 75°). FIG. 12D shows a case in which the welding-line second angle γ is about 90° (the weld line angle before shaping is 90°). In each of FIGS. 12A to 12D, the photograph in the upper stage shows an overall view of the hole 30*a*, and the photograph in the lower stage shows, in an enlarged view, a portion of the intersection between the weld line L and the hole 30*a*. Moreover, an enlarged photograph in the lower stage shows a location where cracking has occurred, by encircling it with a two-dot chain line.

It was confirmed that if the weld line was disposed in the stretch flange deformation field as shown in FIGS. 12A to 12D, cracking occurred in base metal sheet in the vicinity of an intersection point between the weld line L, and the hole 30*a*. Moreover, at any level, cracking occurred in the metal sheet on the side of lower equivalent strength (the metal sheet D in the present test). Results are shown in Table 2 described below.

TABLE 2

| Welding-line Second Angle γ [°] | Welding Line Angle α before Shaping [°] | Hole Expansion Rate [%] |
|---|---|---|
| 43 | 45 | 18 |
| 58 | 60 | 24 |
| 68 | 75 | 21 |
| 90 | 90 | 16 |
| 72 (108) | 105 | 22 |
| 59 (121) | 120 | 25 |
| 44 (136) | 135 | 19 |

The hole expansion rate in Table 2 indicates an average value at each level. The hole expansion rate became most favorable when the welding-line second angle γ was 59°. That is, it was revealed that disposing the weld line such that the BM welding-line direction strain du' defined by the Formula (4) described above decreases will enable improvement of formability while suppressing the occurrence of cracking.

[Collision Test]

A front pillar lower-outer was adopted as a press-formed product of the present embodiment and, on this outer, a test to confirm anti collision performance upon frontal collision was performed by an FEM analysis.

Figure 13:
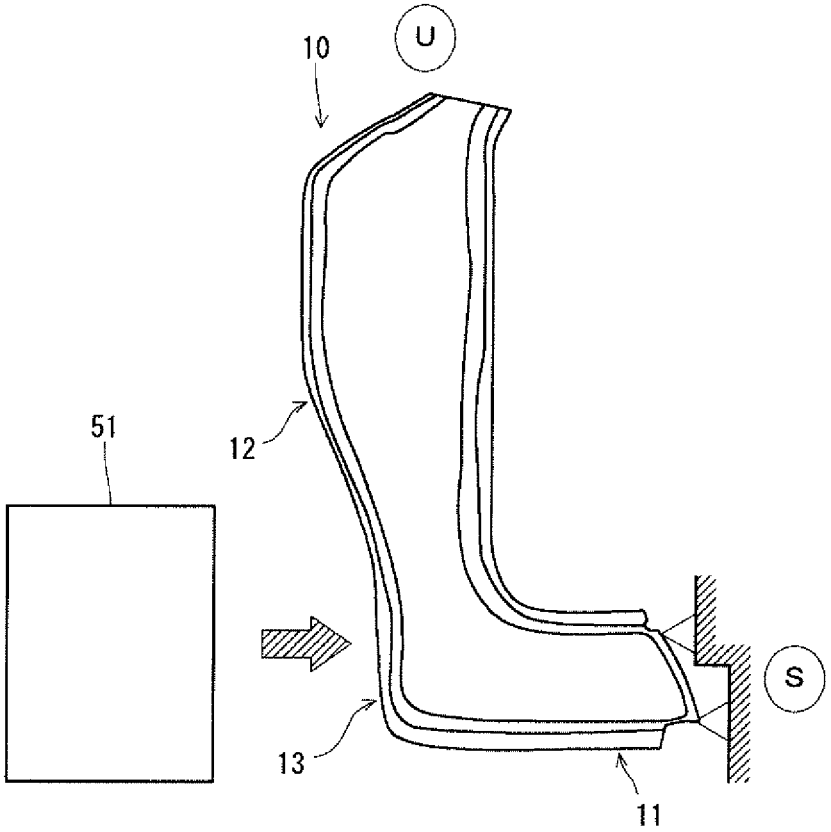
FIG. 13 is a plan view to schematically show an outline of a collision test.

FIG. 13 is a plan view to schematically show an outline of a collision test. FIG. 13 shows an outer 10 and an impactor 51. In a collision test by FEM analysis, a front end section of the first region 11 of the outer 10, that is, the front end section on the side of the side sill was fixed to restrict displacement of the front end section. In this state, the impactor 51 was moved in a horizontal direction at a speed of 15 km/h and was caused to collide with the curved region 13 of the outer 10. Then, the impactor 51 was stopped at a time point when the amount of intrusion of the impactor 51 into the outer 10 became 100 mm.

At that time, the energy that the outer 10 absorbed as the impactor 51 intruded into the outer 10 was determined. By dividing the absorbed energy of the outer 10 by the volume of the outer 10, absorbed energy per unit volume was calculated.

Figure 14A:
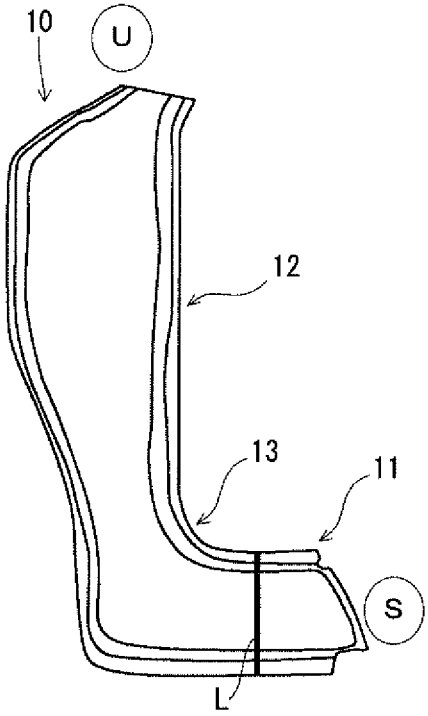
FIG. 14A is a plan view to show a front pillar lower-outer of Comparative Example 1 used in a collision test.
Figure 14B:
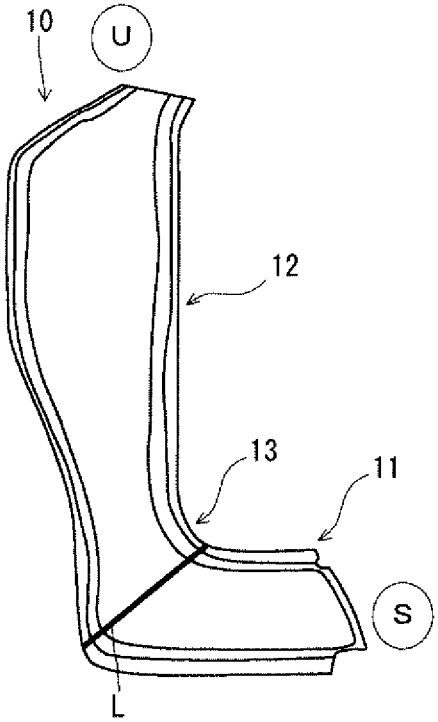
FIG. 14B is a plan view to show a front pillar lower-outer of Inventive Example 1 of the present invention used in the collision test.
Figure 14C:
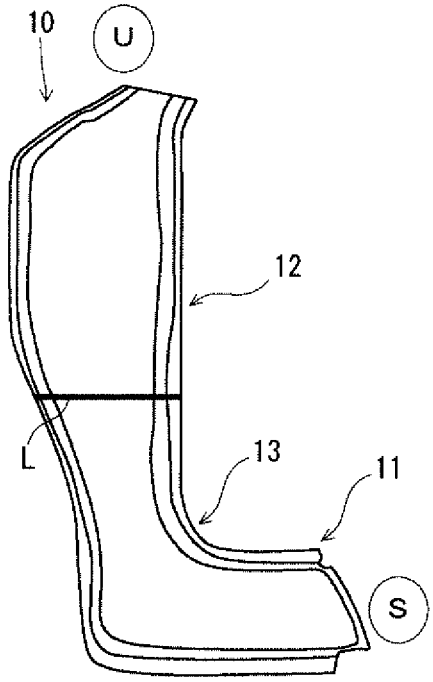
FIG. 14C is a plan view to show a front pillar lower-outer of Comparative Example 2 used in the collision test.

FIGS. 14A to 14C are each a plan view to show a front pillar lower-outer used in the collision test. Among these figures, FIG. 14A shows Comparative Example 1. FIG. 14B shows Inventive Example 1 of the present invention. FIG. 14C shows Comparative Example 2. In Comparative Example 1, as shown in FIG. 14A, the weld line L was disposed in a straight-shaped portion of the first region 11 (on the side of the side sill). In Comparative Example 2, as shown in FIG. 14C, the weld line L was disposed in a straight-shaped portion of the second region 12 (on the side of the front pillar upper). On the other hand, in Inventive Example 1 of the present invention, as shown in FIG. 14B, the weld line L was disposed in a curved region 13 including an arc-shaped area 14 shaped by stretch flange deformation. The welding-line first angle θ of Inventive Example 1 of the present invention was set to 58.2°, and the welding-line second angle γ was set to 54.6°.

In any of Inventive Example 1 of the present invention and Comparative Examples 1 and 2, a metal sheet E was used as the metal sheet on the side of the second region 12 (on the side of the front pillar upper) with respect to the weld line L, and a metal sheet F was used as the metal sheet on the side of the first region 11 (on the side of the side sill) with respect to the weld line L. The metal sheet E was made of 980 MPa class High Tensile Strength Steel, and its sheet thickness was 1.2 mm. The metal sheet F was made of 780 MPa class High Tensile Strength Steel, and its sheet thickness was 1.5 mm. The metal sheet E has a characteristic that it is more subject to cracking compared with the metal sheet F, and the r-value of the metal sheet E was 0.790.

Figure 15A:
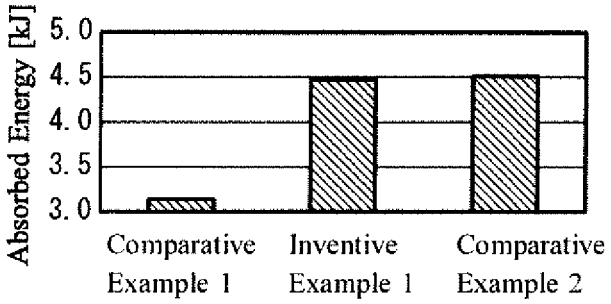
FIG. 15A is a diagram to show test results of a collision test, in which absorbed energy by a front pillar lower-outer is shown.
Figure 15B:
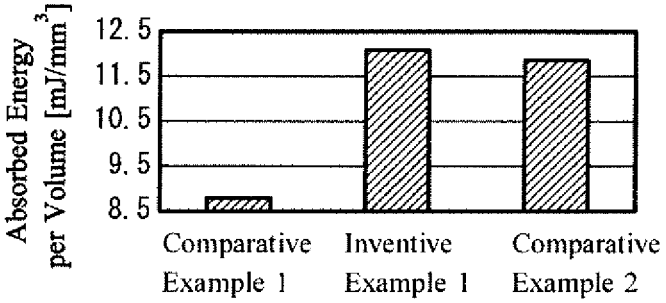
FIG. 15B is a diagram to show test results of collision test, in which absorbed energy per unit volume by the front pillar lower-outer is shown.

FIGS. 15A and 15B are each a diagram to show test results of a collision test. FIG. 15A shows the absorbed energy of the outer. FIG. 15B shows the absorbed energy per unit volume of the outer. From the results of FIGS. 15A and 15B, the followings are indicated.

As shown in FIG. 15A, in Comparative Example 1, as a result of the weld line being disposed in the straight-shaped portion on the side of the side sill, absorbed energy was poor. On the other hand, in Inventive Example 1 of the present invention, as a result of the weld line being disposed in the specified area of the present embodiment, absorbed energy was excellent. Moreover, in Comparative Example 2, as a result of the weld line being disposed in the straight-shaped portion on the side of the front pillar upper, absorbed energy was excellent.

Here, the absorbed energy at the time of collision test varies depending on the sheet thickness. As the area where the sheet thickness is large increases, absorbed energy tends to increase. For that reason, the absorbed energy of Comparative Example 2 which had a larger area of the metal sheet F with a larger sheet thickness was slightly more excellent than the absorbed energy of Inventive Example 1 of the present invention.

On the other hand, as shown in FIG. 15B, regarding the absorbed energy per unit volume, Inventive Example 1 of the present invention was more excellent than Comparative Example 2. This is due to the fact that, regarding the weight of the outer, Inventive Example 1 of the present invention was lighter than Comparative Example 2. Therefore, it became clear that in the viewpoint of combining weight reduction and functional enhancement with a good balance, the outer of the present embodiment excelled.

[Material Yield]

A front pillar lower-outer was adopted as the press-formed product of the present embodiment, and material yield was investigated on a case in which the outer was fabricated from a metal sheet.

Figure 16A:
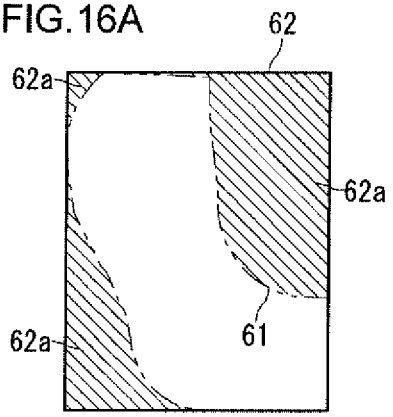
FIG. 16A is a schematic diagram to show a shape of the blank used in press-forming as Comparative Example 3, and a shape of the metal sheet before trimming work which is used for making the blank.
Figure 16B:
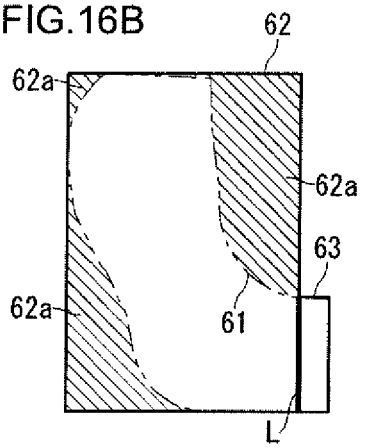
FIG. 16B is a schematic diagram to show a shape of the blank used in press-forming as Comparative Example 4, and a shape of the metal sheet before trimming work which is used for making the blank.
Figure 16C:
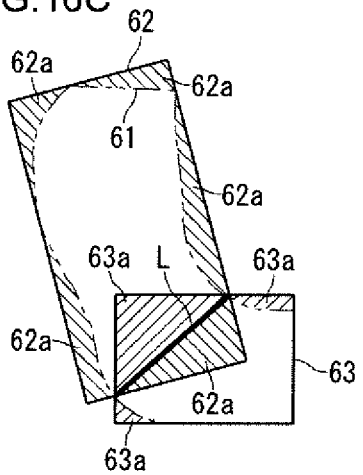
FIG. 16C is a schematic diagram to show a shape of the blank used in press-forming as Inventive Example 2 of the present invention, and a shape of the metal sheet before trimming work which is used for making the blank.
Figure 16D:
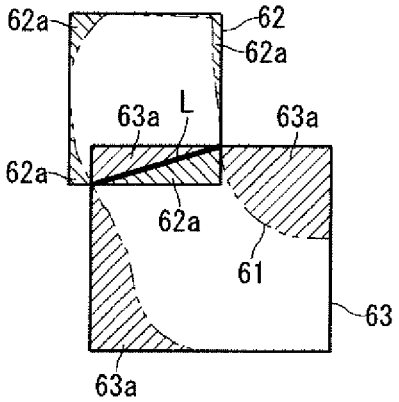
FIG. 16D is a schematic diagram to show a shape of the blank used in press-forming as Comparative Example 5, and a shape of the metal sheet before trimming work which is used for making the blank.

FIGS. 16A to 16D are each a schematic diagram to show a shape of the blank used in press-forming, and the shape of the metal sheet before trimming work which is used for making the blank. Among these figures, FIGS. 16A, 16B, and 16D show Comparative Examples 3, 4, and 5, respectively. FIG. 16C shows Inventive Example 2 of the present invention. In FIGS. 16A to 16D, the shape of the blank 61 used in press-forming is shown with a two-dot chain line; the shapes of the first metal sheet 62 and the second metal sheet 63 before trimming work used for making the blank 61 are shown by a solid line; and the weld line L is shown by a thick line. The first metal sheet 62 and the second metal sheet 63 before trimming work were both made rectangular-shaped. An area 62*a* which was removed by trimming work in the first metal sheet 62, and an area 63*a* which was removed by trimming work in the second metal sheet are cross-hatched, respectively.

As shown in FIG. 16A, in Comparative Example 3, a single metal sheet (first metal sheet 62), not a TWB, was used as the blank for press-forming. As shown in FIG. 16B, in Comparative Example 4, the weld line L was disposed in a straight-shaped portion on the side of the side sill. As shown in FIG. 16D, in Comparative Example 5, the weld line L was disposed in a straight-shaped portion on the side of the front pillar upper. On the other hand, as shown in FIG. 16C, in Inventive Example 2 of the present invention, the weld line L was disposed in an area defined in the present embodiment.

Figure 17:
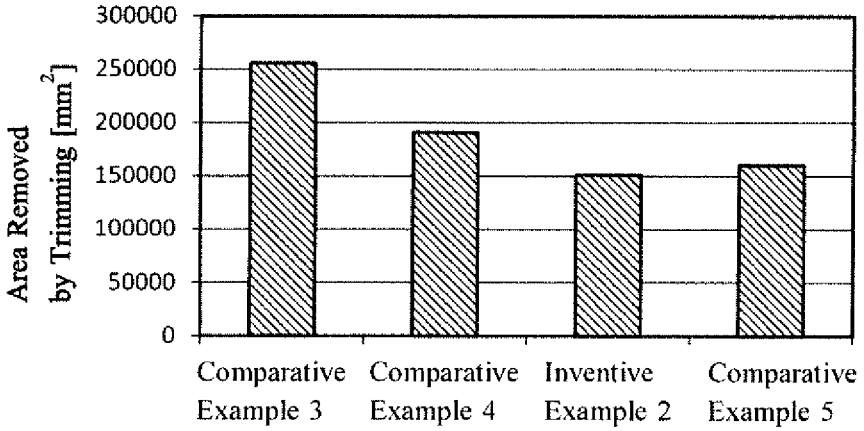
FIG. 17 is a diagram to show an area of the blank which is removed by trimming work for each of Inventive Example 2 of the present invention and Comparative Examples 3 to 5.

FIG. 17 is a diagram to show an area of the blank which was removed by trimming work for each of Inventive Example 2 of the present invention and Comparative Examples 3 to 5. As shown in FIG. 17, the removed area of the blank was minimum in Inventive Example 2 of the present invention. Therefore, it was made clear that according to the outer of the present embodiment, material yield can be improved.

[Simple Method for Setting Welding-Line First Angle θ (Second Angle γ)]

As described so far, disposing the welded line such that the relative difference between the WL welding-line direction strain $d\varepsilon_{WL}y'$ and the BM welding-line direction strain $d\varepsilon y'$ ($d\varepsilon_{BM}y'$) is not more than 0.030 will make it possible to suppress the occurrence of cracking. Therefore, an optimum condition for suppressing cracking is that the relative difference between $d\varepsilon_{WL}y'$ and $d\varepsilon y'$ is 0. That is, $d\varepsilon_{WL}y'$ is equal to $d\varepsilon y'$. Substituting this condition ($d\varepsilon_{WL}y'=d\varepsilon y'$) into Formula (2) described above, and further dividing both sides of Formula (2) described above by the circumferential direction strain $d\varepsilon x$ in the base metal sheet in the vicinity of the weld line will lead to the following Formula (6).

$$d\varepsilon_{WL}y'/d\varepsilon x=(\cos\theta)^2+d\varepsilon y/d\varepsilon x\times(\sin\theta)^2 \quad (6)$$

In Formula (6), since the term "$d\varepsilon y/d\varepsilon x$" in the right-hand side is strain ratio β, substituting the term "$d\varepsilon_{WL}y'/d\varepsilon x$" by χ will lead to the following Formula (7).

$$\chi=(\cos\theta)^2+\beta\times(\sin\theta)^2 \quad (7)$$

From Formula (7), for each welding-line first angle θ, the relationship between a proportion χ of WL welding-line direction strain $d\varepsilon_{WL}y'$ with respect to maximum principal strain $d\varepsilon x$ in the base metal sheet in the vicinity of the weld line, and a strain ratio β, is determined.

Figure 18:
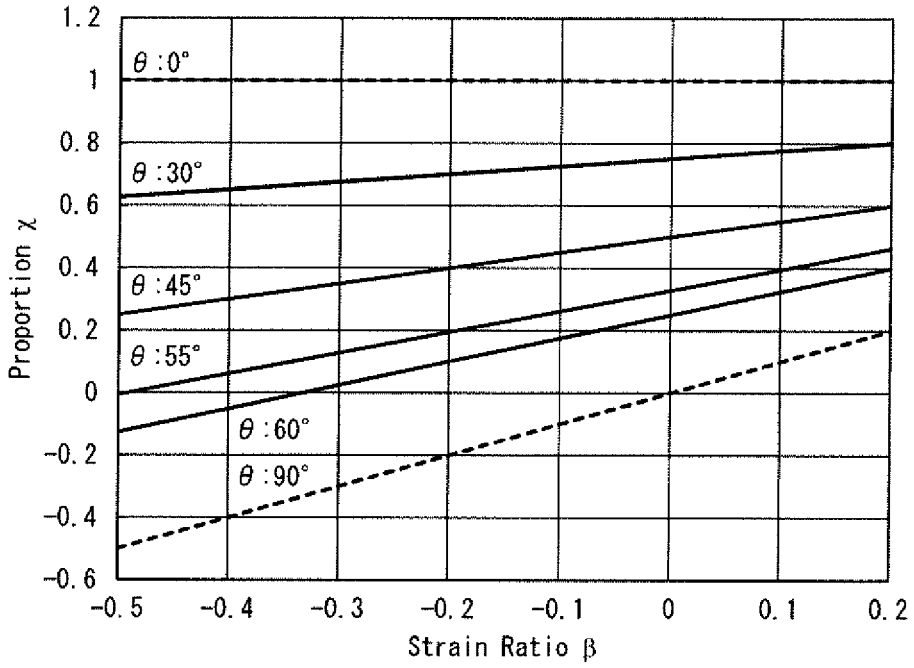
FIG. 18 is a diagram to show an example of a relationship between a proportion χ of WL welding-line direction strain $d\varepsilon_{WL}y'$ with respect to maximum principal strain dεx, and a strain ratio β.

FIG. 18 is a diagram to show an example of a relationship between a proportion $\chi$ of WL welding-line direction strain $d\varepsilon_{WL}y'$ with respect to maximum principal strain $d\varepsilon x$, and a strain ratio 3. As shown in FIG. 18, as the strain ratio $\beta$ increases, the proportion $\chi$ increases. Further, for the same strain ratio $\beta$, as the welding-line first angle $\theta$ decreases, the proportion $\chi$ increases. Therefore, if the WL welding-line direction strain $d\varepsilon_{WL}y'$, the maximum principal strain $d\varepsilon x$, and the strain ratio $\beta$ are known, it is possible to set the welding-line first angle $\theta$ suitable for suppressing cracking. The terms, $d\varepsilon_{WL}y'$, $d\varepsilon x$, and $\beta$ can be easily calculated by an FEM analysis and the like.

INDUSTRIAL APPLICABILITY

The present invention is usable for automobile skeleton components and production thereof.

REFERENCE SIGNS LIST

10: Front pillar lower-outer (press-formed product)
10*a*: Top plate section,
10*b*: First vertical wall section,
10*c*: Second vertical wall section,
10*d*: First flange section,
10*e*: Second flange section,
11: First region,
12: Second region,
13: Curved region,
14: Arc-shaped area,
15: Press-formed product,
15*a*: Top plate section,
15*b*: Vertical wall section,
15*c*: Flange section,
16: Arc-shaped area,
16*a*: Outer peripheral edge of arc-shaped area
16*b*: Inner peripheral edge of arc-shaped area
20: Blank (TWB),
21: First metal sheet,
22: Second metal sheet,
25: Blank (TWB),
A, B: Metal sheet,
26: Die,
27: Punch,
28: Pad,
30: Press-formed product by hole expansion test,
30*a*: Hole,
31: Circular area,
35: Blank (TWB) for hole expansion test,
35*a*: Hole,
41: Die,
41*a*: Aperture,
41*b*: Round chamfered section,
42: Punch,
42*a*: Shoulder section,
43: Blank holder,
51: Impactor,
61: Blank,
62: First metal sheet,
62*a*: Area of first metal sheet to be removed by trimming,
63: Second metal sheet,
63*a*: Area of second metal sheet to be removed by trimming,
L: Weld line.

The invention claimed is:

1. A press-formed product comprising a tailored blank made up of a plurality of metal sheets butt-welded together, wherein the press-formed product includes a flange section, and an arc-shaped area in which an inner peripheral edge is open in the area of the flange section, a weld line of the tailored blank intersects with the inner peripheral edge of the arc-shaped area and an outer peripheral edge of the arc-shaped area, and an angle formed by the weld line and a maximum principal strain direction is 17 to 84°.

2. The press-formed product according to claim 1, wherein an angle formed by the weld line and a tangential line of the inner peripheral edge at an intersection point between the weld line and the inner peripheral edge is 40 to 75°.

3. The press-formed product according to claim 1, wherein a number of the metal sheets for making up the tailored blank is two, and the two metal sheets are different from each other in at least one of tensile strength and sheet thickness.

4. The press-formed product according to claim 3, wherein the press-formed product is an automobile skeleton component which is curved in an L-shape along the longitudinal direction, the skeleton component having a hat-shaped cross section over an entire range in a longitudinal direction;

the skeleton component includes a curved region curved along the longitudinal direction, and a first region and a second region, respectively extending from both ends of the curved region, the skeleton component being supposed to be subjected to a collision load along an extended direction of the first region;

the arc-shaped area is a flange section on an inner side of curve of the curved region; and a sheet thickness of the metal sheet disposed on the side of the first region is larger than a sheet thickness of the metal sheet disposed on the side of the second region.

5. The press-formed product according to claim 4, wherein the skeleton component is a front pillar lower-outer, and the first region is coupled to a side sill, and the second region is coupled to a front pillar upper.

6. The press-formed product according to claim 4, wherein a difference between a multiplication value of a tensile strength and a sheet thickness of the metal sheet disposed on the side of the first region, and a multiplication value of a tensile strength and a sheet thickness of the metal sheet disposed on the side of the second region is not more than 600 mm·MPa.

7. A method for designing the press-formed product according to claim 1, the press-formed product being shaped by press working from a tailored blank made up of a plurality of metal sheets butt-welded together, wherein the press-formed product includes a flange section, and an arc-shaped area which is formed by stretch flange deformation and in which an inner peripheral edge is open, in the area of the flange section, in which a weld line of the tailored blank intersects with the inner peripheral edge of the arc-shaped area and an outer peripheral edge of the arc-shaped area, and wherein when designing the press-formed product, the weld line is disposed such that during press working, a relative difference between strain $d\varepsilon_{WL}y'$ in a direction along the weld line at a center in a width direction of the weld line, and strain $d\varepsilon y'$ in a direction along the weld line in the vicinity of the weld line of the metal sheet is not more than 0.030.

8. The method for designing a press-formed product according to claim 7, wherein the relative difference between strain $d\varepsilon_{WZ}y'$ and strain $d\varepsilon y'$ is 0.

* * * * *